US006712874B1

(12) United States Patent
Hämäläinen et al.

(10) Patent No.: US 6,712,874 B1
(45) Date of Patent: Mar. 30, 2004

(54) METHOD FOR THE REDUCTION OF NICKEL FROM AN AQUEOUS SOLUTION

(75) Inventors: Matti Hämäläinen, Aittaluodonkatu (FI); Sigmund Fugleberg, Eerikinkatu (FI); Kari Knuuttila, Gallen-Kallelankatu (FI)

(73) Assignee: Outokumpu Oyj, Espoo (FI)

( * ) Notice: Subject to any disclaimer, the term of this patent is extended or adjusted under 35 U.S.C. 154(b) by 0 days.

(21) Appl. No.: 10/129,867

(22) PCT Filed: Oct. 27, 2000

(86) PCT No.: PCT/FI00/00933

§ 371 (c)(1),
(2), (4) Date: May 9, 2002

(87) PCT Pub. No.: WO01/34857

PCT Pub. Date: May 17, 2001

(30) Foreign Application Priority Data

Nov. 9, 1999 (FI) ..... 19992408

(51) Int. Cl.[7] ..... B22F 9/26
(52) U.S. Cl. ..... 75/374
(58) Field of Search ..... 75/371, 374

(56) References Cited

U.S. PATENT DOCUMENTS 2,753,257 A 7/1956 Nasher et al.
3,833,351 A 9/1974 Neskora et al.
4,547,347 A * 10/1985 Lussiez et al. ..... 423/141
4,758,266 A * 7/1988 Chou ..... 75/374
4,761,177 A * 8/1988 Chou et al. ..... 75/374
5,135,567 A * 8/1992 Volotinen et al. ..... 75/374

OTHER PUBLICATIONS

Kunda, W., et al., "Effect of Addition Agents on the Properties of Nickel Powders Produced by Hydrogen Reduction", Sherritt Gordon Mines Limited, Pergamon Press, 1966, pp. 15–16.*
Benson B. Colvin "Plant Practice in the Production of Nickel byt Hydrogen Reduction", Mines Research Foundation, Inc. (1963) vol. 24, pp. 735–752.
Evans et al. "Production of Metals by Gaseous Reduction From Solution–Processes and Chemistry", Institution of Mining and Metallurgy, (1968) pp. 831–907.
Fathi Habashi "Pressure Hydrometallurgy: Key T Better and Nonpolluting Process" Engineering and Mining Journal (1971) vol. 172 pp. 96–900.

* cited by examiner

*Primary Examiner*—George Wyszomierski
(74) *Attorney, Agent, or Firm*—Morgan & Finnegan, L.L.P.

(57) ABSTRACT

The invention relates to a method for the precipitation of nickel from an aqueous solution containing its sulphate as a metallic powder suitable as an alloying element for refined steel. In this method, nickel reduction takes place continuously in one or several autoclaves at a temperature of 80–180° C. and hydrogen pressure of 1–20 bar, whereby the production capacity can be raised significantly, compared to batch processes made in correspondingly dimensioned devices or equipment.

29 Claims, 2 Drawing Sheets

METHOD FOR THE REDUCTION OF NICKEL FROM AN AQUEOUS SOLUTION

Figure 1:
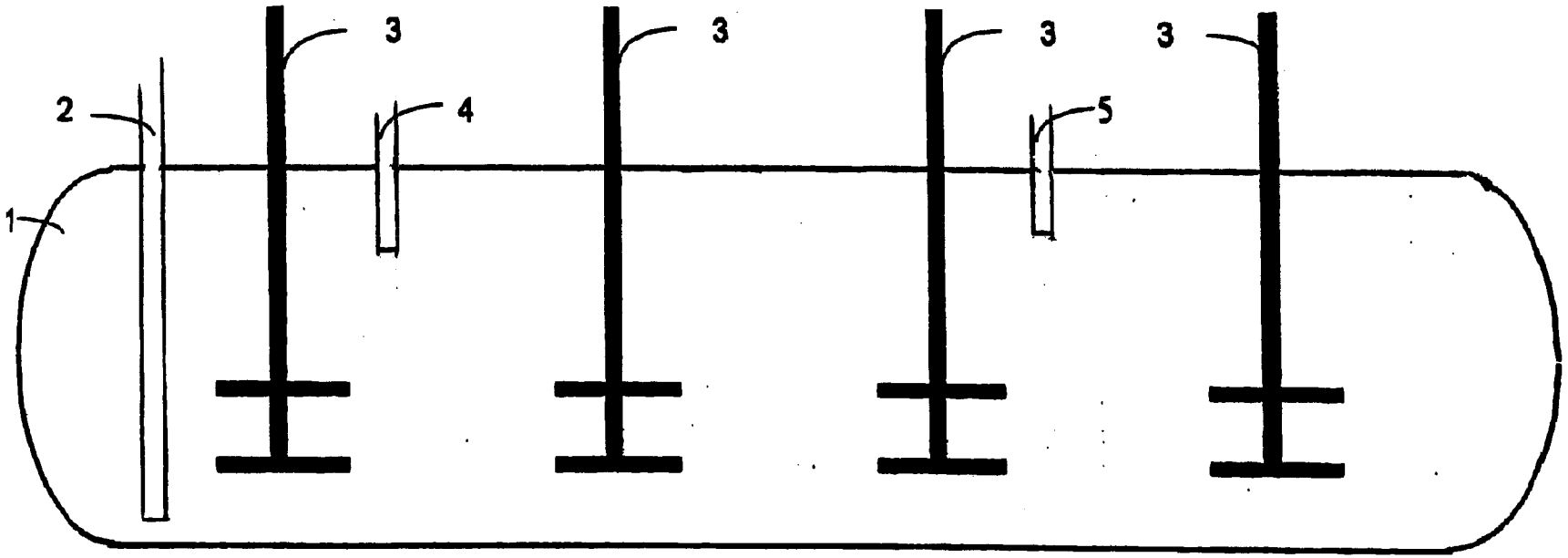

The present invention relates to a method for the precipitation of nickel as a metallic powder suitable for the production of refined steel from an aqueous solution containing its sulphate. In this method, nickel reduction takes place continuously in one or several autoclaves at a temperature of 80–180° C. and hydrogen pressure of 1–20 bar, whereby the production capacity can be raised significantly, compared to batch processes made in correspondingly dimensioned devices or equipment.

The production of nickel from an aqueous solution by hydrogen reduction in autoclaves as batches has been in use on industrial scale since the 1950s. The method is described in articles such as: Benson, B., Colvin, N.: "Plant Practice in the Production of Nickel by Hydrogen Reduction", pp. 735–752 in the conference publication: Wadsworth, M. E., Davies, F. T. (ed.): "Unit processes in Hydrometallurgy", International Symposium in Hydro-metallurgy, Dallas, Feb. 24–28, 1963, Gordon and Breach, New York, 1964. The production method described in the article is still in use through-out the industry and according to the article the method based on the batch principle comprises the following stages: nucleus reduction, reduction and leaching.

In the batch process, nickel nuclei are made in an autoclave by hydrogen reduction using an $FeSO_4$ catalyst. When the nuclei are ready, the mixers are stopped, the nuclei are allowed to settle and the solution on top of the nuclei powder is blown off. In the reduction stage the actual process solution is fed into the autoclave and metallic nickel is reduced from this with hydrogen on top of the nuclei. Reduction typically occurs at temperatures of 199–204° C., and at overpressures of 24–31 bar. When reduction has ended, the mixers are stopped, the powder is allowed to settle to the bottom of the autoclave and the solution is removed from on top of the settled powder. The method is repeated 50–60 times and some nickel powder is also removed when the solution is removed. The reduction series or cycle is finished when the particle size of the nickel powder grows so large that its suspension in the autoclave becomes difficult or when the reduction time of one batch becomes too great. At the end of the reduction cycle the whole autoclave is emptied. Any metallic nickel stuck to the inner structure of the autoclave is dissolved off between cycles.

It is clear to a person skilled in the art that the actual reduction stage of the batch process comprises at least the pumping of the pre-heated solution to the autoclave, the hydrogen reduction of the batch of the nickel solution, the settling of the nickel powder and blowing off the residual solution from the top of the nickel powder. All these sub-stages are performed as consecutive actions, not simultaneously. However, only the hydrogen reduction of the nickel solution is effective time from a production point of view and it can be calculated from the above-mentioned article by Benson and Colvin, that this operation uses only 45% of the total time. The capacity of the method can be calculated from this article as:

$$251 \text{ batches} \times 46 \text{ g Ni/l}/(14d^* \; 24h/d) = \text{approx.}34 \text{ (g Ni/l)/h.}$$

The article by Evans, D. J. I.: "Production of Metals by Gaseous Reduction from Solution", Processes and Chemistry, Paper 35/Advances in Extractive Metallurgy, A symposium in London, April, 17–20 , 1967, The Institution of Mining and Metallurgy, mentions that the particle size generated by the nuclei reduction described above is of the order of 0.001 mm.

Metallic nickel production by hydrogen reduction as a continuous process is presented in U.S. Pat. No. 2,753,257. The patent mainly describes reduction in batch processes, but the examples also mention continuous processes. In relation to continuous processes it is stated that a maximum yield of 80% can be achieved and that the batch method should be used for better results. It is characteristic of the said method firstly that the composition of the solution is adjusted twice, and secondly that the iron present in the solution has an adverse effect on the functioning of the method.

In U.S. Pat. No. 2,753,257 the composition of the solution is first adjusted to the optimum demanded for self-nucleation. In the second stage the composition of the solution is adjusted so that it is optimal for the reduction of the metal powder on top of the metal nuclei. It is also supposed in the method that iron is eliminated from the solution by some known method to content levels that do not interfere with the reduction of the metallic powder. The method is performed at a temperature range of 218–232 ° C. and at 52–55 bar of overpressure.

Another continuous process is presented in U.S. Pat. No. 3,833,351. This describes a method for the production of copper, nickel, cobalt, silver or gold powders from a solution prepared by acid or ammoniacal leaching. Powder production is carried out by reduction with hydrogen gas in a continuous vertical tubular reactor, where the height to diameter ratio of the reactor is at least 10:1. In the patent description it states that powders can be produced in the reactor even in atmospheric conditions. However, the section describing the production of nickel for example reveals that if reduction is carried out in conditions where the average temperature of the reactor is 93° C. and the pressure about 32 bar (Table III, Run 2), the resultant solid matter contains only 55% nickel. If economically viable results are required, reduction must be carried out in conditions where the total pressure is for instance in the range of 33 bar and the average temperature 140° C. with a maximum temperature of 225° C. (Run 1), whereby the amount of nickel powder formed is 90% of the solid matter. The resulting nickel is not only impure but also extremely fine and thus awkward to handle. The size of the powder produced was 0.001–0.002 mm for copper and so small for nickel and cobalt that ordinary settling and filtering may no longer work, requiring perhaps even magnetic separation in order to separate the particles from the solution. The fineness of the powder also greatly hinders washing. This method has never been implemented on industrial scale.

Autoclaves equipped with partitions are used for continuous precipitation and leaching autoclaves, as described e.g. in the article by F. Habashi, Pressure Hydrometallurgy: Key to Better and Nonpolluting Processes, Engineering and Mining Journal, February , 1971, pp. 96–100 and May 1971, pp. 88–94. Partition walls have not been used in reduction autoclaves.

From the above, we can conclude that the nickel hydrogen reduction method has worked relatively well in the batch process, and attempts to convert to a continuous process have been rather poor. The reasons for this have probably been the high temperatures and pressure used in reduction processes, which have made it difficult to change the process over to a continuous one.

A continuous process is cheaper than a batch process, because the production capacity of equipment of the same size is greater than that of a batch process. Now, with the method of the present invention, nickel powder especially suitable as an alloying element for refined steel can be produced by performing continuous hydrogen reduction of a nickel sulphate-containing aqueous solution in a pressurised space in easier conditions than earlier, wherein the hydrogen pressure is in the range of 1–20 bar and the temperature in the range of 80–180° C., (preferably with hydrogen pressure from 2–10 bar and the temperature from 110–160° C.). According to the invention, at least one autoclave is used as the pressurised space, being equipped with partition walls, which divide it into several sections with mixers, or several consecutive autoclaves with mixers, which autoclaves may be single or multi-sectioned. The invention is particularly advantageous when using nickel sulphate solutions obtained in acid leaching and which therefore do not practically contain ammonium sulphate. The essential features of the invention will be made apparent in the patent claims.

Nickel sulphate-containing aqueous solutions are generally prepared by leaching either nickel concentrate such as laterites or pyrometallurgically produced nickel mattes. The leaching may be either acid or ammoniacal. The nickel content of the sulphate solution usually remains lower in concentrate leaching than in matte leaching, but if liquid-liquid leaching is used as one solution purification step, the nickel content can easily rise to over 100 g/l. In the framework of this invention, reduction is performed from a solution with a nickel content of minimum 30 g/l, preferably at least 50 g/l and most advantageously minimum 80 g/l.

For reduction in a pressurised space, the composition of the nickel sulphate solution feed is adjusted before reduction in a preparation stage, which comprises a number of mixing reactors. The adjustment of the solution composition is carried out only once. If there is any iron in the solution, ferrous sulphate is made use of to form nuclei, on which nickel powder is reduced. If the amount of iron in the solution is not sufficient as it is, iron is added to the solution. In place of iron or in addition to it, chrome can be used for nucleus formation as chrome (II) sulphate $CrSO_4$. Ammonia can also be used for composition adjustment as can the feed of other additives and admixtures normally used in reduction.

If autoclaves divided into sections are used in embodiments of the invention, the upper edges of the partitions are essentially horizontal and their heights from the lowest point of the bottom of the autoclave is graded so that the height of the partition walls seen in the direction of the solution flow decreases, so that the surface of the solution in the sections decreases correspondingly. Gradation can of course be implemented in some other suitable way, for example, so that the partitions are the same height, but have discharge slots or apertures at different heights. The purpose of the partitions is to improve the efficiency of the autoclave.

Figure 2:
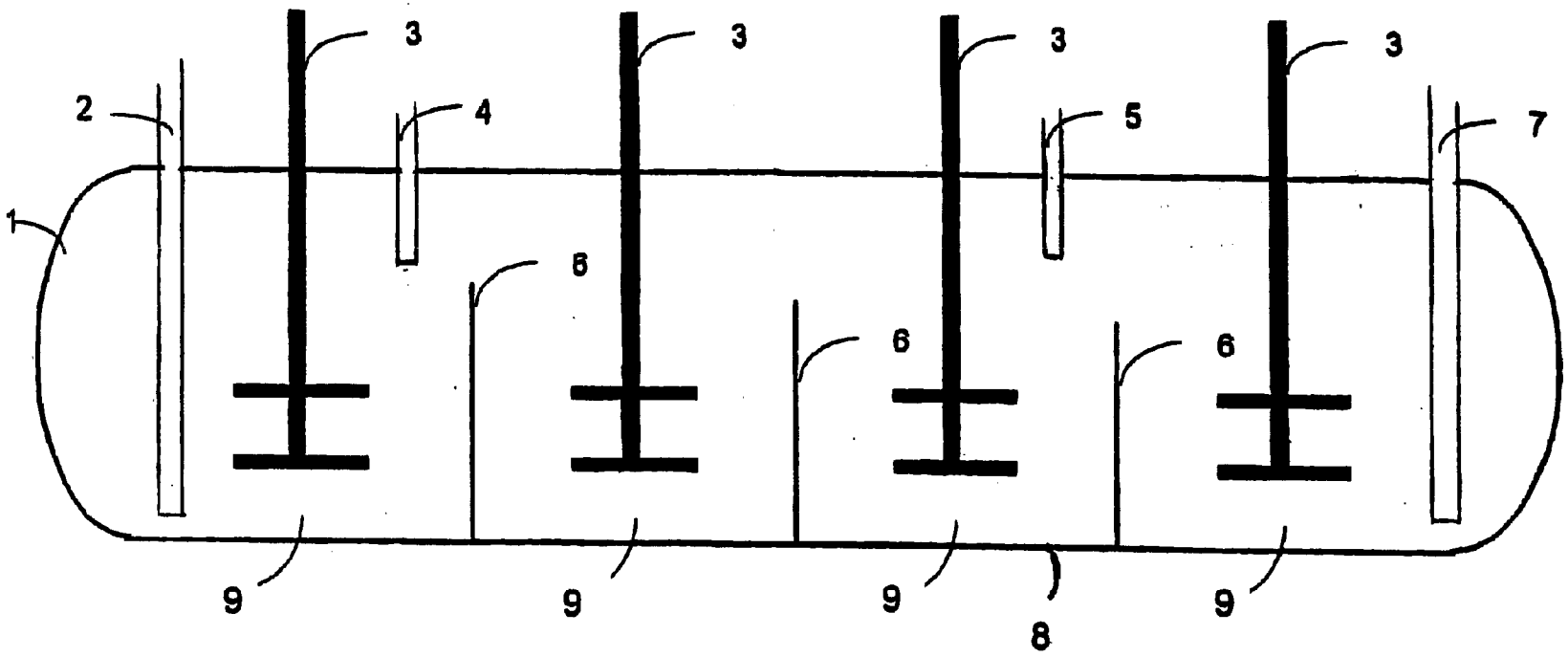

The method of the invention is described further by the accompanying drawings, where FIG. 1 is a vertical section of the principles of an autoclave of the prior art and FIG. 2 a vertical section of the principles of an autoclave divided into sections with partitions according to the invention.

FIG. 1 is an example of a reduction autoclave 1 of the prior art, functioning on a batch basis, which autoclave is single-sectioned and equipped with a feed and discharge pipe 2 for the slurry to be reduced, mixers 3, gas feed pipe 4 and gas exhaust pipe 5. The number of mixers in the autoclave can be changed as can the positions of the slurry and gas feed points.

Reduction autoclaves of the prior art do not have partitions dividing the space into sections—the whole pressurised space is integrated.

When the method according to the present invention is implemented in a single autoclave, it is preferable to use an autoclave as in FIG. 2, which is in principle the same type as presented above, but equipped with partitions 6 and a discharge pipe 7 for the solution and the solid material at the back section of the autoclave. The autoclave shown in the figure is a typical horizontal cylindrical shape. When the suspension of solution and solid matter have been discharged from the autoclave, the nickel powder is separated from the end solution by well-known methods such as filtration. As stated above, the heights of partitions 6 are graded from the bottom 8 of the autoclave so that the height of the partition walls decreases in the direction of the solution flow. The number of mixers and sections 9 is not restricted to the four shown in the diagram, but can be changed. Preferably there will be 3–6 sections divided by partitions, but that can also vary if the need arises. The mixers may be single or multi-bladed. It is clear to a skilled person that the partitions may include apertures and other standard components to improve the efficiency and ease operation of the autoclave at various points, in the normal way.

An autoclave according to this invention may also be an integral type as in FIG. 1, wherein several of them are positioned one after the other in a series in continuous methods. In this case the single autoclave is equipped with a separate discharge pipe 7 for removing the solution as in FIG. 2, through which the solution is conveyed to the next autoclave. A combination of said autoclaves may also be used i.e. there may be single-section and multi-section autoclaves connected consecutively in a series. A single-section autoclave may also be for example a vertical cylindrical form, but single-section autoclaves are also always equipped with mixers.

When hydrogen reduction of an aqueous nickel solution (nickel sulphate solution) is performed with the method now developed, significantly lower temperatures and pressures can be used in the autoclave than shown in the prior art. Thanks to this, the hydrogen reduction of a nickel solution can be converted or be made continuous from the start, whereby the capacity of the autoclave or the group of autoclaves rises considerably compared to the batch process. Thus the nickel solution hydrogen reduction process can be operated continuously, when the hydrogen pressure is in the range of 1–20 bar and the temperature from 80–180° C., preferably at a temperature of 110–160° C. with the hydrogen pressure in the range of 2–10 bar.

For example $Fe^{2+}$and $Cr^{2+}$are used as reduction catalysts, which are added to the reduction feed solution at the feed solution preparation stage, just before the solution is charged into the autoclave or directly into the reduction autoclave. The catalyst is charged at least partially in solution form. $Fe^{2+}$and $Cr^{2+}$as catalysts are not harmful to the quality of the product. Two thirds of the nickel produced in the world is currently used in the production of refined steel. Consequently, any iron contained in the nickel is of no concern. Should chrome be used as reduction catalyst instead of iron, traces of the former will not cause any problems in refined steel production either. Iron and chrome compounds are preferably iron (II) and chrome (II) sulphates, but it is also possible to use other such chemical compounds as catalysts that do not harm refined steel production or that are removed from the nickel powder during the sintering of briquettes.

Where necessary well-known additives are used with the purpose of preventing the plating of metal on the autoclave walls and other inner elements, and/or of influencing the form of the powder flakes or their agglomeration or dispersion tendencies.

The acid generated in reduction is neutralised preferably with ammonia. Advantageously ammonia is mixed into the solution at the preparation stage before the solution is fed into the autoclave, but an ammonia addition may also be made directly into the autoclave. In both cases, it is beneficial to select the amount of ammonia so that the mole ratio $NH_3$/Ni (=added ammonia/total amount of nickel in feed) is 1.6–2.4.

If the metallic nickel generated in the autoclave includes hydroxide-containing compounds, they can be leached off in the method described in U.S. Pat. No. 3,833,351 with an ammonium hydroxide and/or sulphuric acid solution and the solution obtained returned to a part of the process prior to reduction i.e. the solution preparation stage, preferably to its final reactor.

When the capacity of the present method is calculated in the same way as for embodiments of the prior art, a result of 100–130 (g Ni/l) Th is obtained. The capacity achieved with the method of the present invention is thus at least twice that of the method described in the prior art. With the present developed method nickel powder suitable as raw material for the refined steel industry as such, in briquette form or in briquettes and sintered, can now be produced at an amazingly large capacity, at an amazingly low temperature and pressure.

After reduction occurring in a pressurised space there is always a little nickel left in the solution i.e. in the end solution to be removed after separation of the nickel powder. The method now developed allows for variation in nickel content in the end solution. If this so-called residual nickel amount is very small, e.g. under 1 g/l, it may be recovered by for instance sulphide precipitation or ion exchange, and returned to a stage in the process preceding reduction. If the amount of residual nickel is greater,it can also be crystallised from the end solution in a known way such as by cooling, evaporation and if necessary using ammonium sulphate additive as nickel ammonium sulphate. The small amount of nickel left in the solution after crystallisation can be removed, for example, by sulphide precipitation or ion exchange.

If the nickel content of the remaining solution is fairly small, the resulting nickel ammonium sulphate $NiSO_4.(NH_4)_2SO_4.6H_2O$ can be dissolved with an addition of ammonia into the feed solution at the autoclave feed solution preparation stage, whereby the nickel cycle in the process is made as short as possible.

If the nickel content of the residual solution is so great that returning $NiSO_4.(NH_4)_2SO_4.6H_2O$ to the nickel autoclave reduction would raise the ammonium sulphate content of the reduction feed solution so much that the reduction of nickel would be slowed down significantly, the $NiSO_4.(NH_4)_2SO_4.6H_2O$ can be dissolved with ammonia into a solution containing ammonium sulphate and the solution thus obtained fed further as in the method described in the Benson and Colvin article into a separate autoclave operating on the batch principle.

The invention is illustrated in more detail by the following examples:

EXAMPLE 1

A test was made in a horizontal cylindrical autoclave, which was divided into six sections by partitions. In addition to the sections the partitions further divided the autoclave into two spaces: the gas space above the upper edges of the partitions and the solution or slurry space around the partitions. The total volume of the autoclave was 75 l, of which the gas volume was about a third and the slurry volume about 50 l.

The upper edges of the section partitions were essentially horizontal and their heights from the bottom graded so that the height of the partitions dropped in the direction of the slurry flow. Thus the highest partition was-in the feed section of the autoclave and the lowest between the last two sections. Along with the partitions the slurry surface level also decreased: towards the back section of the autoclave. Owing to this the slurry fed into the first section flowed from one section to the next by the effect of gravity ending finally in the last section, from where the slurry was removed from the autoclave by means of the prevailing gas pressure in the autoclave.

Each section was equipped with an effective rotating mixer with a basically vertical shaft with two mixing elements on the same shaft as shown in FIG. 2. The mixers sucked the hydrogen gas from the gas space and dispersed it into the slurry, thus speeding up the dissolving of the hydrogen and the forming of nickel. The mixers also kept the nickel generated in the autoclave well suspended, which helped it to proceed from one section to another.

The ammonium sulphate free solution used in the tests had been through solution purification and contained on average 108 g Ni/l as sulphate. Gaseous ammonia was added to this as neutralising agent so that the mole ratio was 2.2 mole $NH_3$/mole Ni and ferrous sulphate in aqueous solution in order to form the nuclei so that the weight ratio became 0.007 g $Fe^{2+}$/1 g Ni. The addition of ammonia took place as a continuous process in several mixing reactors operating in series and at normal pressure. The slurry generated was pumped continuously into the autoclave so that the average retention time in the autoclave was 0.9 h. The addition of ferrous sulphate was made just before the solution was fed into the autoclave i.e. into the feed pipe between the last mixing reactor and the autoclave.

The temperature of the mixing reactors was 80° C. and the temperature of the autoclave was about 120° C. and the hydrogen pressure 5 bar. The test lasted 56 hours, during which time an average of 5.3 kg Ni/h was fed into the autoclave as solution and as precipitate. The end solution to be removed from the autoclave after nickel separation contained on average 4.6 g Ni/l, in other words 0.25 kg Ni/h and the iron content of the solution was 0.11 g/l. The yield of nickel to metal was thus about 95% and the calculated production capacity of the autoclave regarding slurry volume about 100 (g Ni/l)/h.

EXAMPLE 2

The autoclave described above was used in the test and the ammonium sulphate free nickel sulphate solution used as feed had been through solution purification and contained on average 113 g Ni/l. Gaseous ammonia was added to this so that the mole ratio was 2.0 mole $NH_3$/mole Ni and ferrous sulphate was added so that the weight ratio became 0.007 g $Fe_{2+}$/1 g Ni. The addition of ammonia and ferrous sulphate to ok place as in example 1. The average e retention time of the slurry in the autoclave was 0.8 h.

The temperature of the mixing reactors was 80° C. and the temperature of the autoclave was about 120° C. and the hydrogen pressure 5 bar. The test lasted 78 hours, during which time an average of 6.7 kg Ni/h was fed into the autoclave as solution and as precipitate. The end solution to be removed from the autoclave after nickel separation contained on average 2.2 g Ni/l, in other words 0.14 kg Ni/h and the iron content of the solution was 0. 17 g/l. The yield of nickel to metal was thus about 98% and the calculated production capacity of the autoclave regarding slurry volume about 130 (g Ni/l)/h.

As stated above, the production capacities achieved in the examples are considerably higher than the capacities apparent from the articles mentioned in the prior art. The examples presented above include a larger campaign, where nickel powder was produced with an iron content of 0.1–2.0% and analysis otherwise corresponding to LME classification. According to sieve analyses of the powders, their 50% passing through grain size was about 0.050 mm, i.e. extremely large in comparison with that in the above-mentioned method of the prior art-powder produced by so-called nuclear reduction, where the grain size is of the order of 0.001 mm. The grain size is also larger than the powder produced by the method in U.S. Pat. No. 3,833,351, where at most it (copper powder) was of the order of 0.002 mm.

The powders produced in the examples were pressed and sintered into briquettes, which after sintering in a hydrogen atmosphere contained 0.64–0.91% Fe, about 0.01% S and about 0.02% C. and which had a compression strength of over 3000 kg/cm$^2$. The product is suitable for use in the refined steel industry.

EXAMPLE 3

The following pair of tests illustrate the effect of the ammonium sulphate content of the reduction autoclave feed solution on the nickel reduction rate. The tests were made in a three-sectioned continuous, FIG. 2 type autoclave, with the following operating conditions: temperature 120° C. and hydrogen pressure 5 bar. The feed slurries were prepared as in example 2 and were pumped continuously to the autoclave so that the retention time was 70 min i.e. about 23 min/section. In test 3.1 the slurry did not contain any ammonium sulphate, but in test 3.2 the amount was 34 g/l. The results obtained were as follows:

TABLE 1

| | $(NH_4)_2SO_4$ content in | Ni content of solution g/l | | |
|---|---|---|---|---|
| Test | feed g/l | Section 1 | Section 2 | Section 3 |
| 3.1 | 0 | 27.5 | 12.6 | 2.7 |
| 3.2 | 34 | 34.1 | 21.3 | 16.0 |

The table shows the slowing effect of ammonium sulphate on the reduction rate of nickel sulphate. It also shows that the nickel content of the end solution of test 3.2, that is the solution coming from the third section, was 16.0 g/l and the ammonium sulphate content of the feed solution 34 g/l, which as moles are approximately of equal size. In fact in the case of test 3.2 the crystallised $NiSO_4.(NH_4)_2SO_4.6H_2O$ from the reduction end solution can be returned to the reduction autoclave without essentially altering its operation.

EXAMPLE 4

The following series of tests illustrate the effect of temperature and pressure on the reduction rate. The series of tests was made in the same continuous, 6-sectioned autoclave as the tests in examples 1 and 2. The test conditions and results were as follows:

TABLE 2

| | Feed | | | Conditions | | Product |
|---|---|---|---|---|---|---|
| Test | Ni g/l | $NH_3$/Ni mole/mole | Fe g/l | T ° C. | $p_{H2}$ bar | Ni g/l |
| 4.1 | 100 | 2.3 | 0.5 | 120 | 5.0 | 15 |
| 4.2 | 100 | 2.3 | 0.5 | 130 | 5.0 | 7 |
| 4.3 | 100 | 2.3 | 0.5 | 130 | 2.5 | 22 |

The feed did not contain ammonium sulphate and product refers to the nickel powder from the autoclave end solution after separation. The amount of feed was 50 l/h or a total retention time of 1 h.

These results show that a relatively small change in temperature and hydrogen pressure can have a considerable effect on nickel reduction rate and on the nickel content of the autoclave end solution.

EXAMPLE 5

The crystallisation of $NiSO_4.(NH)_4SO_4.6H_2O$ from the reduction end solution was also tested. The test was made in a small laboratory mixing reactor. The feed solution, which contained about 5 g/l nickel and about 100 g/l ammonium sulphate, was taken from the campaign of examples 1 and 2.

In the crystallisation test, solid ammonium sulphate was added to the feed solution so that the solution content was 380 g/l $(NH_4)_2SO_4$. After this the pH of the solution was adjusted to a value of 3 and its temperature to 40° C., when it was mixed in the reactor for 60 min. During mixing, the analyses of the samples taken from the reactor were as follows:

TABLE 3

| Mixing time min | Ni content of solution g/l |
|---|---|
| 0 | 4.2 |
| 10 | 0.89 |
| 30 | 0.63 |
| 60 | 0.78 |

This shows that the residual nickel in the reduction end solution can easily be crystallised to a level where the final nickel can be removed, for instance by sulphide precipitation or ion exchange.

What is claimed is:

1. A method of the reduction of nickel powder suitable as a component of refined steel, comprising reducing an aqueous solution containing nickel sulphate in a pressurised space using hydrogen as the reducing agent, the reduction occurring continuously at a temperature between 110–160° C. and at a hydrogen pressure between 2–10 bar in at least one autoclave, which is divided into sections by partitions, where each section is equipped with a mixer, and removing the aqueous solution from the at least one autoclave.

2. A method according to claim 1, wherein the height of the solution surface decreases by section in the direction of the solution flow.

3. A method of the reduction of nickel powder suitable as a component of refined steel, comprising reducing an aqueous solution containing nickel sulphate in a pressurised space using hydrogen as the reducing agent, the reduction occurring continuously at a temperature between 110–160° C. and at a hydrogen pressure between 2–10 bar in a plurality of autoclaves, wherein reduction occurs in said autoclaves, which are arranged in series and equipped with mixers, and removing the aqueous solution from said autoclaves.

4. A method according to claim 3, wherein the autoclaves are single-sectioned.

5. A method according to claim 3 wherein the autoclaves arranged in series are both single and multi-sectioned.

6. A method according to claims 1 or 3, wherein the autoclaves are essentially cylindrical in shape.

7. A method according to claim 3 wherein the aqueous solution is removed from said autoclaves through a discharge pipe.

8. A method according to claim 3, wherein the nickel sulphate solution is obtained in acid leaching.

9. A method according to claim 1, wherein the nickel content of the aqueous solution containing nickel sulphate fed into the pressurised space is at least 30 g/l.

10. A method according to claim 9, wherein the nickel content of the aqueous solution of nickel fed into the pressurised space is at least 50 g/l.

11. A method according to claim 1, wherein the composition of the aqueous solution containing nickel sulphate fed into the pressurised space is adjusted at the feed solution preparation stage.

12. A method according to claim 1, wherein a reduction catalyst is used to aid reduction.

13. A method according to claim 12, wherein iron (II) sulphate, $FeSO_4$, is used as reduction catalyst.

14. A method according to claim 12, wherein chrome (II) sulphate, $CrSO_4$, is used as reduction catalyst.

15. A method according to claims 11 or 12, wherein the reduction catalyst is added to the feed solution at the preparation stage.

16. A method according to claim 12, wherein the reduction catalyst is added to the feed solution just before the solution is fed into the pressurised space.

17. A method according to claim 12, wherein the reduction catalyst is fed directly into the pressurised space.

18. A method according to claim 1, wherein the solution to be fed into the pressurised space is neutralised at the preparation stage with ammonia so that the mole ratio becomes 1.6–2.4.

19. A method according to claim 1, wherein the nickel solution is neutralised with ammonia in the pressurised space so that the mole ratio becomes 1.6–2.4.

20. A method according to claim 1, wherein the nickel solution contains practically no ammonium sulphate.

21. A method according to claim 1, wherein the suspension of nickel powder and solution is removed from the pressurised space and from which suspension the nickel powder is separated.

22. A method according to claim 21, wherein the nickel remaining in the end solution after separation is removed by sulphide precipitation or ion exchange.

23. A method according to claim 21, wherein at least part of the nickel remaining in the end solution after separation is removed as a binary salt $NiSO_4*(NH_4)_2SO_4*6H_2O$.

24. A method according to claim 23, wherein when the majority of the nickel from the end solution has been recovered as a binary salt, the residual nickel is removed from the end solution either by sulphide precipitation or ion exchange.

25. A method according to claim 23, wherein binary salt $NiSO_4*(NH_4)_2SO_4*6H2O$ is dissolved in the preparation stage of the feed solution and returned as feed for the continuous hydrogen reduction of nickel in a pressurised space.

26. A method according to claim 23, wherein binary salt $NiSO_4*(NH_4)_2SO_4*6H_2O$ is dissolved in the preparation stage of the feed solution and fed to the hydrogen reduction of nickel as a batch process.

27. A method according to claims 25 or 26, wherein binary salt $NiSO_4*(NH_4)_2SO_4*6H_2O$ is dissolved using ammonia.

28. A method according to claim 1 wherein the aqueous solution is removed from the at least one autoclave through a discharge pipe.

29. A method according to claim 1, wherein the nickel sulphate solution is obtained in acid leaching.

* * * * *